US006837080B2

(12) United States Patent
Lee

(10) Patent No.: US 6,837,080 B2
(45) Date of Patent: Jan. 4, 2005

(54) COMBINATION LOCK

(76) Inventor: Po-Yen Lee, 5F, No. 2, Alley 17, Lane 80, Chung-Cheng Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/449,767

(22) Filed: Jun. 2, 2003

(65) Prior Publication Data

US 2004/0237610 A1 Dec. 2, 2004

(51) Int. Cl.[7] ..... E05B 13/00; E05B 37/16

(52) U.S. Cl. ..... 70/214; 70/298; 70/313; 70/314

(58) Field of Search ..... 70/214, 313, 314, 70/287, 288, 297–300

(56) References Cited

U.S. PATENT DOCUMENTS

| | | | | | |
|---|---|---|---|---|---|
| 1,871,303 | A | * | 8/1932 | Chesick | 70/284 |
| 2,029,080 | A | * | 1/1936 | Mills | 70/214 |
| 2,494,015 | A | * | 1/1950 | Tate et al. | 200/43.12 |
| 2,566,967 | A | * | 9/1951 | Soler Capdevila | 70/299 |
| 2,750,786 | A | * | 6/1956 | Sanowskis | 70/313 |
| 3,009,346 | A | * | 11/1961 | Check | 70/150 |
| 3,412,587 | A | * | 11/1968 | Sanowskis | 70/313 |
| 3,722,238 | A | * | 3/1973 | Ring | 70/278.1 |
| 3,751,951 | A | * | 8/1973 | Gridley | 70/313 |
| 4,748,833 | A | * | 6/1988 | Nagasawa | 70/214 |
| 4,827,743 | A | * | 5/1989 | Kim | 70/214 |
| 4,956,985 | A | * | 9/1990 | Kim | 70/313 |
| 6,334,346 | B1 | * | 1/2002 | Wang | 70/214 |

FOREIGN PATENT DOCUMENTS

| | | | | |
|---|---|---|---|---|
| SU | 672321 | * | 7/1979 | 70/214 |
| WO | WO 85/05399 | * | 12/1985 | 70/314 |

* cited by examiner

*Primary Examiner*—Lloyd A. Gall
(74) *Attorney, Agent, or Firm*—Birch, Stewart, Kolasch & Birch, LLP

(57) ABSTRACT

A combination lock includes a core unit, a locking mechanism, and a reset mechanism formed of a guide rod, a sliding plate, a stop rod and a reset member. The sliding plate is downwards to push the locking mechanism to the unlocking position wherein operation buttons pressed subject to the set code. When the locking mechanism lifted to push the reset member of the reset mechanism, the locating rod of the reset member pushes the stop rod away from the rack of the sliding plate, enabling the sliding plate to be returned by a spring member so that the core unit is returned to the initial position for resetting the code.

7 Claims, 5 Drawing Sheets

COMBINATION LOCK

BACKGROUND OF THE INVENTION

1. Field of the Invention

The present invention relates to a combination lock and, more particularly, to a combination lock with a modularized core unit that enables to the user to reset the code without the key, and provides an anti-piracy function.

2. Description of the Related Art

Regular commercially available combination locks include electronic pushbutton digits type combination locks and mechanism pushbutton type combination locks. According to conventional designs, the code control mechanism is not a standardized independent unit for use in different locking devices of different functions and shapes. According to the aforesaid two types of combination locks, a reset button is needed to clear error signal or to given an initial working signal. This arrangement is not safe because the code can easily be pirated by other people.

There is also known a combination lock, which achieves the code control by means of the arrangement of N and S poles of magnetic elements subject to a predetermined order. This design of combination lock is functional. However, opening this design of combination lock requires a specially designed key. This specially designed key is complicated. Further, the user cannot change the code of the key.

Therefore, it is desirable to provide a combination lock, which eliminates the aforesaid drawbacks.

SUMMARY OF THE INVENTION

The present invention has been accomplished under the circumstances in view. It is therefore the main object of the present invention to provide a combination lock, which enables the user to reset the code when desired. It is another object of the present invention to provide a combination lock, which effectively prevents piracy of the code by other people. According to one aspect of the present invention, the combination lock is comprised of a core unit, a reset mechanism, and a locking mechanism. When the core unit unlocked, the locking mechanism drives the reset mechanism to release the sliding plate of the core unit, enabling the core unit to be turned to the initial state for re-setting the code. According to another aspect of the present invention, the combination lock has a code. If the combination lock is not operated subject to the order of the code, real-code buttons and false-code buttons of the core unit will drive the reset mechanism to work, stopping the sliding plate of the core unit from downward movement or returning the sliding plate to its initial position, and therefore the code entry is destroyed, not able to open the lock.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings, which are given by way of illustration only, and thus are not limitative of the present invention, and wherein:

DETAILED DESCRIPTION OF THE PREFERRED EMBODIMENT

Figure 1:
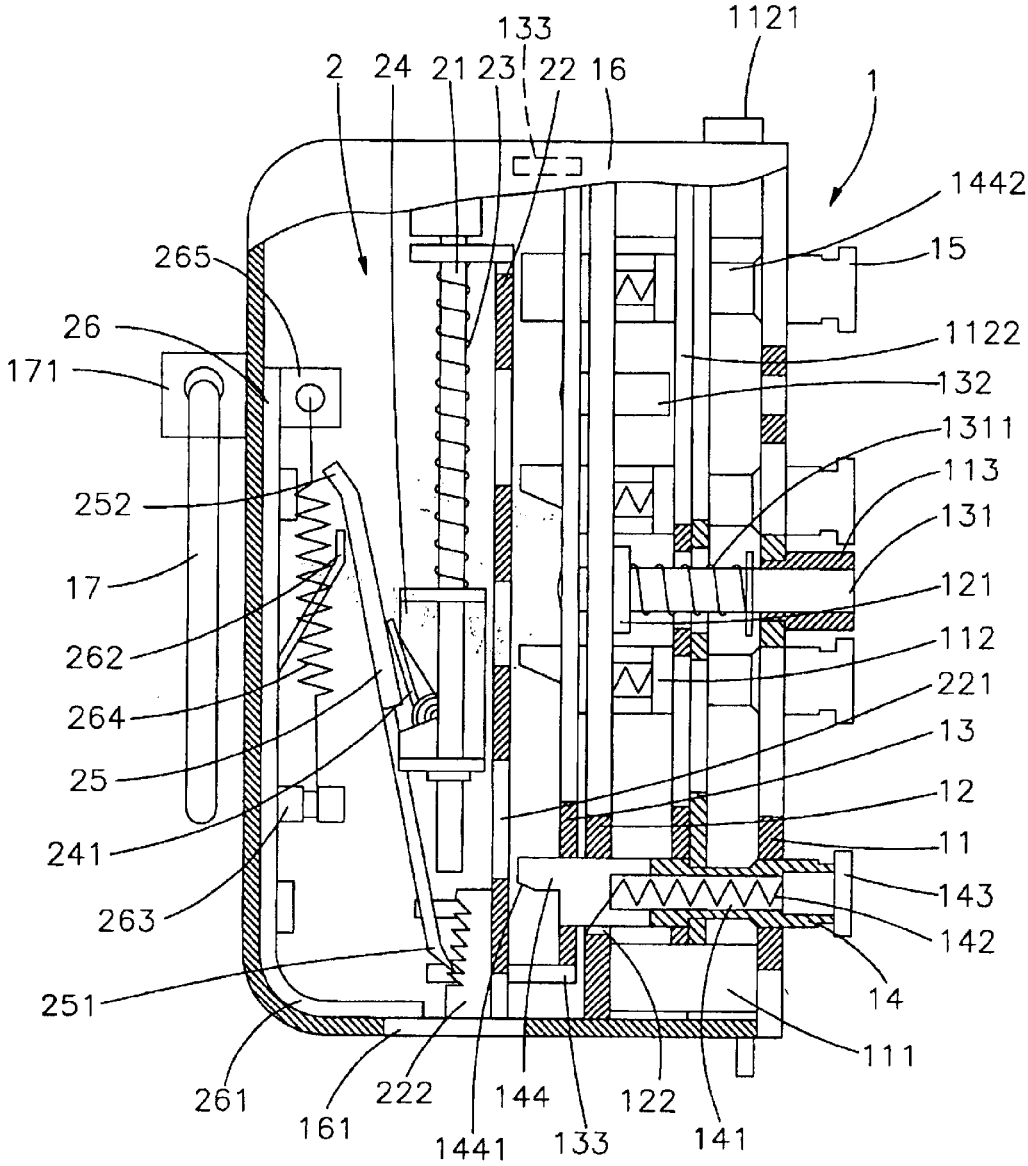
FIG. 1 is a side view in section of a combination lock according to the present invention.
Figure 2:
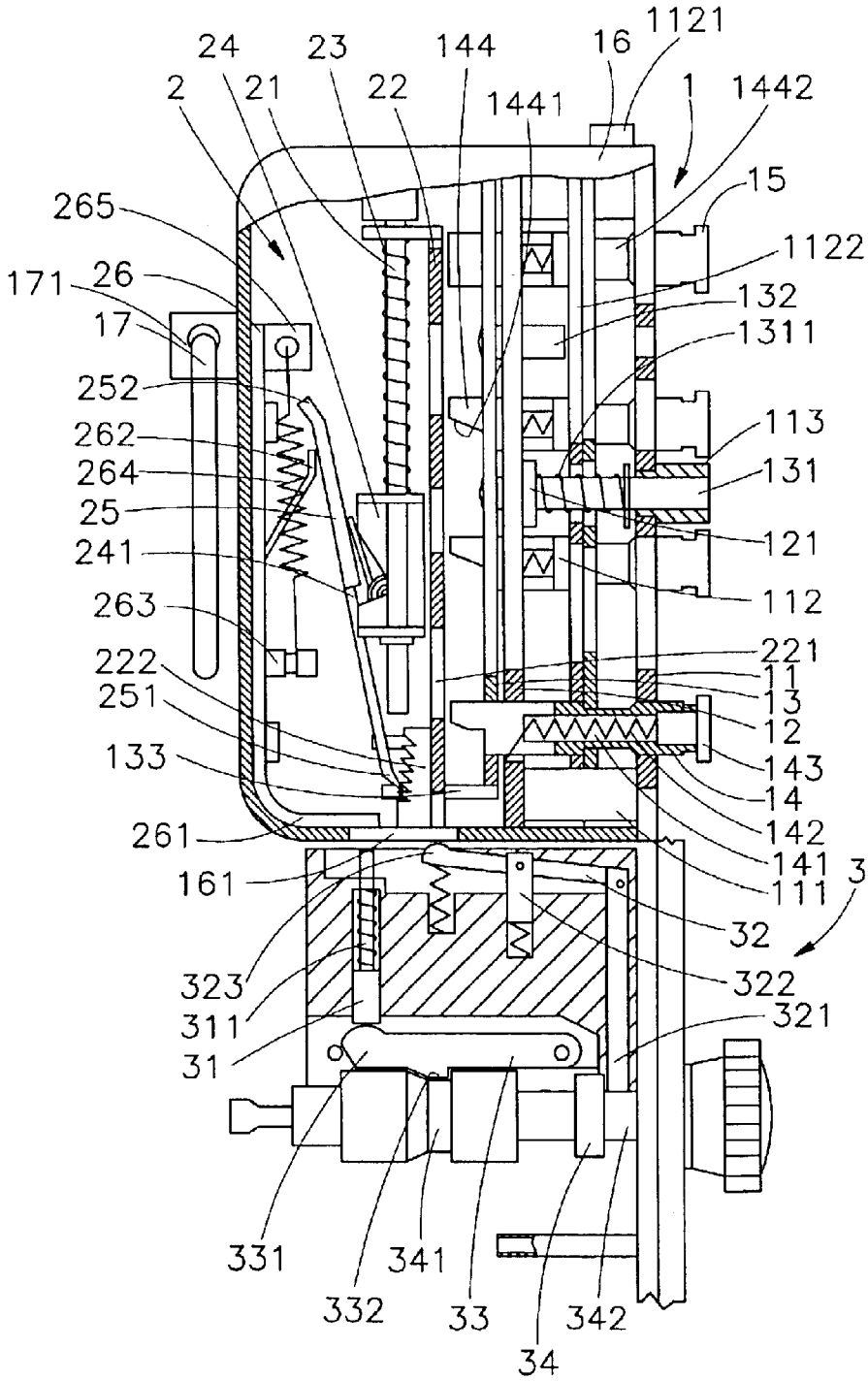
FIG. 2 is another side view of the combination lock according to the present invention.

Referring to FIGS. 1 and 2, a combination lock in accordance with the present invention is shown comprised of a core unit 1, a reset mechanism 2, and a locking mechanism 3.

The core unit 1 comprises an outer partition plate 11, an inner partition plate 12, a push board 13, real-code buttons 14, false-code buttons 15, and a shell 16. The shell 16 is a substantially ⊏-shaped member having a bottom through hole 161. The outer partition plate 11 and the inner partition plate 12 are mounted in the shell 16 and joined by posts 111. A movable security member 112 and a support member 1122 are mounted in between the outer partition plate 11 and the inner partition plate 12. The push board 13 is disposed at an inner side relative to the inner partition plate 12, comprising an upright center guide rod 131, a locating rod 132, and two locating end flanges 133. The center guide rod 131 is axially movably inserted through an axle bush 121 in the inner partition plate 12 and an axle bush 113 in the outer partition plate 11. A return spring 1311 is mounted on the center guide rod 131 and supported between the outer partition plate 11 and the inner partition plate 12.

The buttons (real-code buttons 14 and false-code buttons 15) are axially movably inserted through (a respective through hole 122 in) the inner partition plate 12 and (a respective through hole in) the outer partition plate 11, each having an annular groove 1441 around the respective periphery on the middle and coupled to the security member 112. The security member 112 stops the buttons 14 and 15 from escaping out of the core unit 1. The outer partition plate 11 and the outside wall of the combination lock have corresponding marks marked thereon by the side of the respective through holes for the buttons 14 and 15. Each button 14 or 15 comprises an axially extended chamber 141, a return spring 142 mounted in the chamber 141, a screw bolt 143 threaded into the chamber 141 and stopped against one end of the return spring 142. The other end of the return spring 142 extends out of the bottom side of the chamber 141 and fastened to the periphery of the corresponding through hole 122 in the inner partition plate 12 for enabling the respective button 14 or 15 to be moved axially in the corresponding through hole 122. The screw bolt 143 of the real-code button 14 has a corresponding digit (or letter) marked on the top surface of the head thereof and equiangularly arranged in an order. Each real-code button 14 has a front end terminating in a push rod 144, which passes through the inner partition plate 12, and has a beveled push face 1441. The transverse width of the push rod 144 varies in different directions and is angularly gradually increased subject to the order and positions of the digits (or letters) on the top surface of the head of the screw bolt 143. The push rod 144 of the false-code button 15 does not have such beveled push face 1441 or the aforesaid features.

The reset mechanism 2 is installed in the inner side of the inner partition plate 12 inside the shell 16, comprised of a guide rod 21, a sliding plate 22, a return spring 23, a holder frame 24, a stop rod 25, and a reset member 26. The guide rod 21 is fixedly connected between the two end flanges 133 of the push board 13 of the core unit 1. The sliding plate 22, the return spring 23 and the holder frame 24 are respectively mounted on the guide rod 21. The sliding plate 22 has a rectangular opening 221 and a rack 222 at the bottom side. The holder frame 24 is mounted on the guide rod 21. The return spring 23 is sleeved onto the guide rod 21 and stopped against the holder frame 24, which is stopped at a locating ring A at one end of the guide rod 21. The holder frame 24 has a torsional spring 241 located on the inside. The stop rod 25 is mounted in the holder frame 24 and coupled to the torsional spring 241, having a bottom stop end 251 curved at an acute angle and engaged with the rack 222 at the bottom side of the sliding plate 22 and a top end 252 connected to a projecting rod 262 at the reset member 26. A pin F is mounted in the stop rod 25 to secure the stop rod 25 and a spring member E to the holder frame 24. The reset member 26 is an angled member having a longitudinal sliding slot (not shown) longitudinally disposed on the middle and coupled to the bottom side of the shell 16 by a rivet B, a push portion 261 at one end, an eye lug 265 at the other end, a locating rod 263 riveted to the bottom side of the shell 16, a tensile spring 264 connected between the eye lug 265 and the locating rod 263. The projecting rod 262 is located on a middle part of the reset member 26. A ring handle 17 is coupled to a shaft 171 outside the shell 16.

The locking mechanism 3 is fixedly fastened to the bottom side of the shell 16, comprising a push rod 31, an actuating rod 32, a movable stop rod 33, and a shaft 34. The push rod 31 and the actuating rod 32 are respectively aimed at a through hole 161 in the shell 16. The push rod 31 is supported on a spring 311 and forced by the spring 311 against the free end 331 of the movable stop rod 33. A pivot C pivots the other end of the movable stop rod 33 to the locking mechanism 3. The movable stop rod 33 has a sloping projection 332 engaged into an annular locating groove 341 around the periphery of the shaft 34. The shaft 34 has another annular locating groove 342 for the engagement of a locking rod 321, which has the other end pivoted to one end the actuating rod 32. The actuating rod 32 has a middle part pivoted to a support rod 322, and the other end terminating in a press portion 323, which extends to the through hole 161 of the shell 16.

Figure 3:
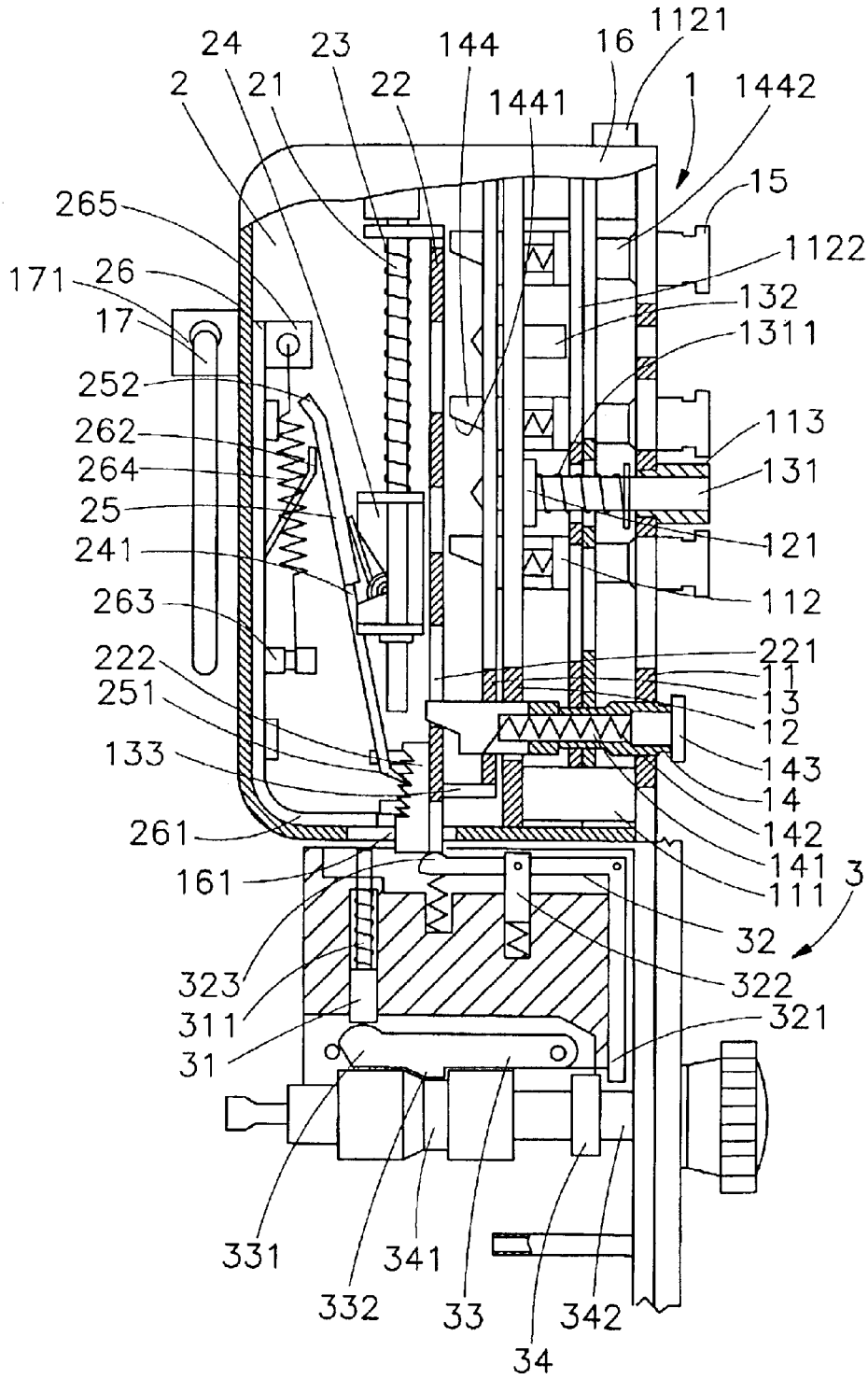
FIG. 3 is a sectional view showing the action of the core unit according to the present invention (I).
Figure 4:
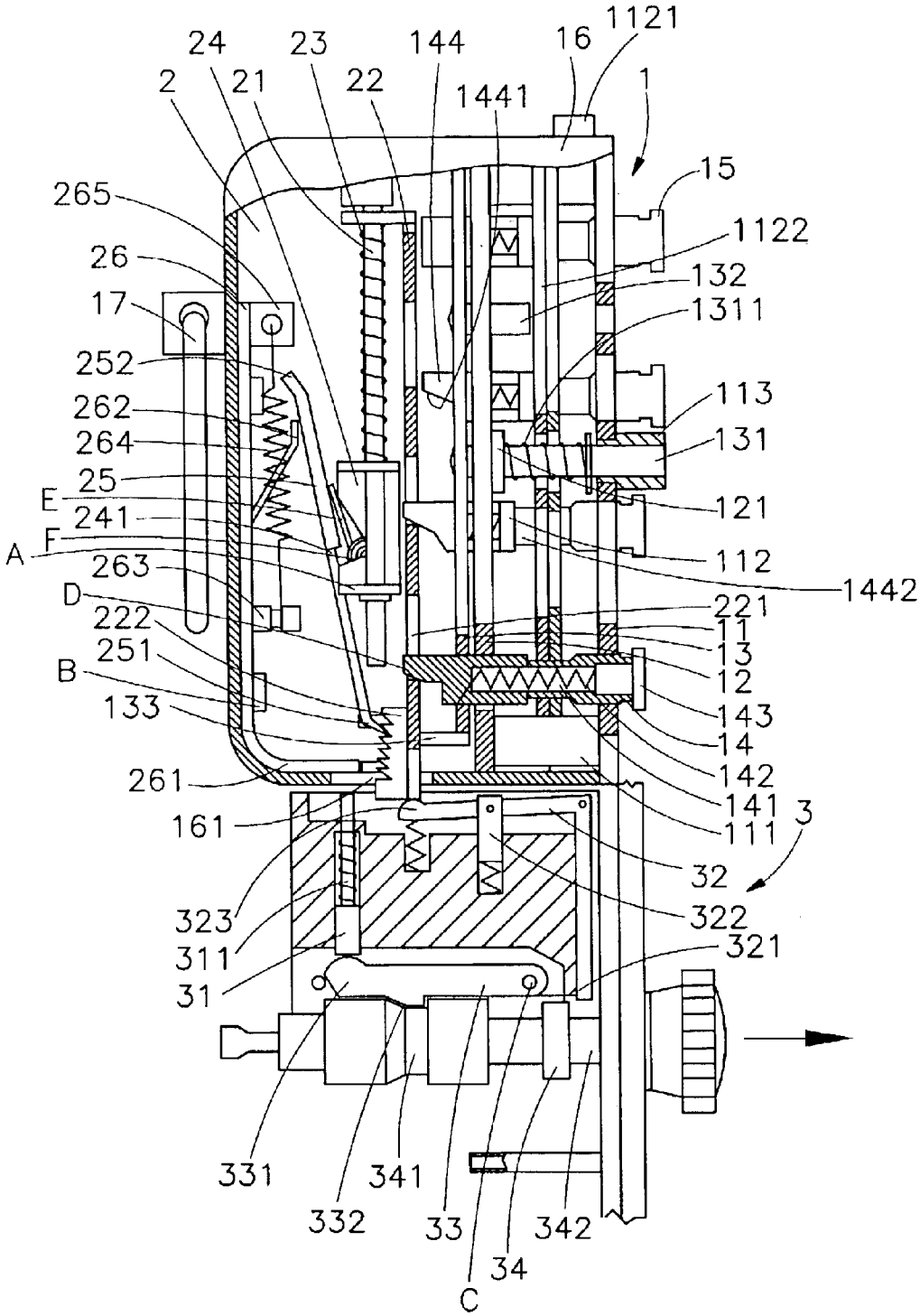
FIG. 4 is a sectional view showing the action of the core unit according to the present invention (II).
Figure 5:
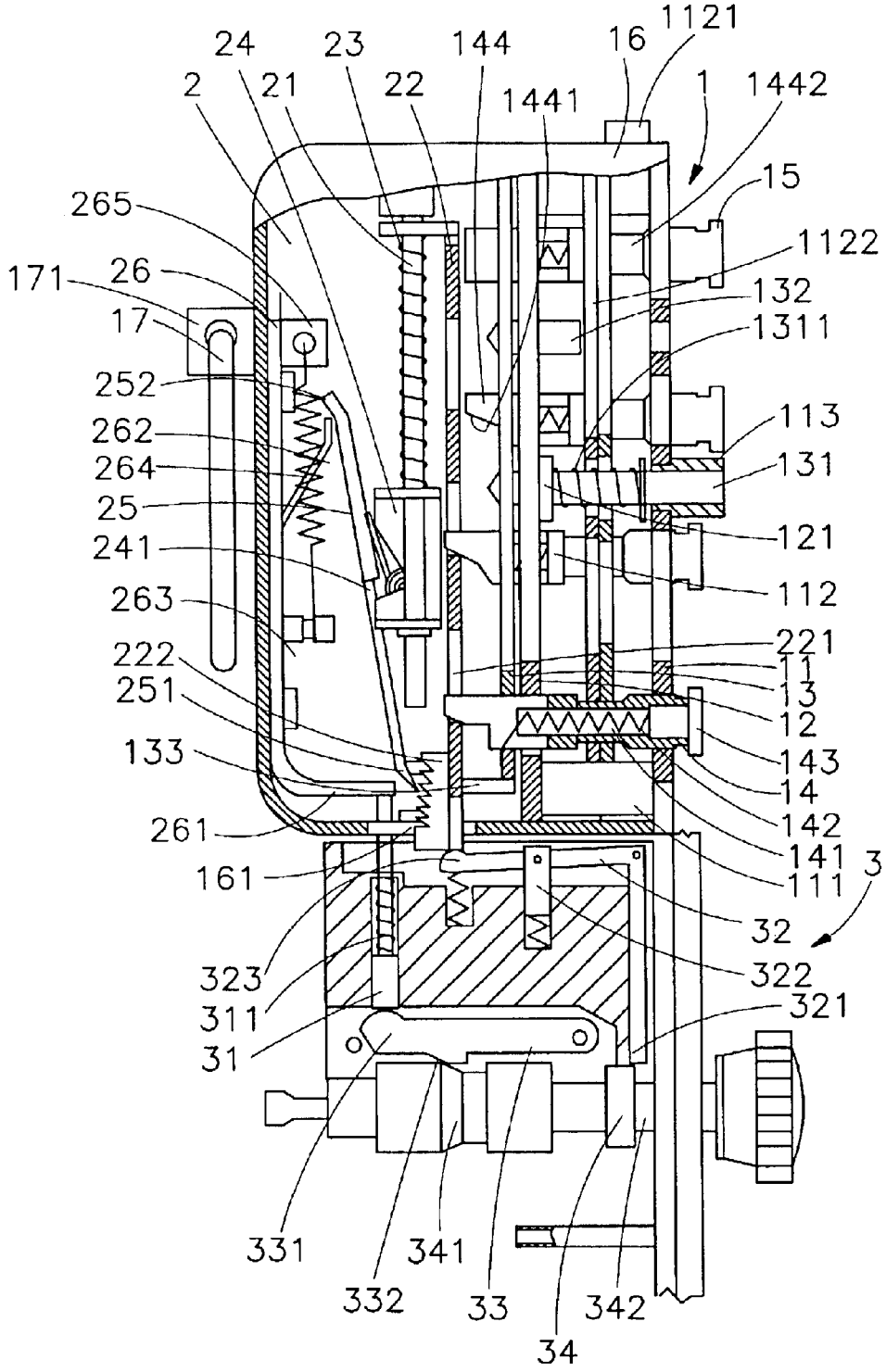
FIG. 5 is a sectional view showing the action of the reset mechanism according to the present invention.

Referring to FIGS. 3~5, the bottom side of the rectangular opening 221 of the sliding plate 22 is disposed below the end of the real-code button 14. When pressing one real-code buttons 14, the respective push rod 144 is moved horizontally to force the respective beveled push face 1441 into contact with the periphery of the rectangular opening 221 of the sliding plate 22 and to further push the sliding plate 22 downwards at a distance equal to the tooth pitch of the rack 222 of the sliding plate 22. When the user pressed the assigned real-code buttons 14 subject to the set code, the sliding plate 22 is moved downwards to extend the rack 222 to the outside of the through hole 161 of the shell 16 and to force the actuating rod 32 of the locking mechanism 3, thereby causing the locking rod 321 to be lifted from the annular locating groove 342 of the shaft 34 to unlock the locking mechanism 3.

When the locking mechanism 3 unlocked, the push rod 31 of the locking mechanism 3 is moved upwards against the push portion 261 of the reset member 26 to lift the reset member 26, thereby causing the projecting rod 262 to push the top end 252 of the stop rod 25, and therefore the stop rod 25 is forced to disengage the bottom stop end 251 from the rack 222 of the sliding plate 22. When the bottom stop end 251 of the stop rod 25 disengaged from the rack 222 of the sliding plate 22, the return spring 23 immediately returns the sliding plate 22, and the respective return springs 142 force the respective real-code buttons 14 to their reset position, and therefore the core unit 1 is reset.

If the buttons 14 and 15 are pressed not subject to the predetermined code, the vertical side D of each pressed button 14 or 15 will push the sliding plate 22 along the guide rod 21 to move the push board 13 horizontally, causing the holder frame 24, the stop rod 25, the center guide rod 131, and the locating rod 132 to be moved with the sliding plate 22 horizontally to force the top end 252 of the stop rod 25 against the projecting rod 262 of the reset member 26. Therefore, the stop rod 25 is turned clockwise to move the bottom stop end 251 away from the rack 222 of the sliding plate 22, enabling the return spring 23 to return the sliding plate 22, i.e., the combination lock is maintained in the locked status.

The combination lock has an anti-piracy function. The first one of the real-code buttons 14 (the real-code button that is marked with digit "I") does not provide a re-setting function. However, the other buttons 14 and 15 provide a re-setting function, i.e., the other buttons 14 and 15 can be pressed subject to the predetermined code to unlock the combination lock after having been pressed incorrectly.

Further, when changing the code, remove the locking mechanism 3 from the shell 16 than then press the extension end 1121 of the movable security member 112 to release the buttons 14 and 15, and then install the selected real-code buttons 14 in the coded holes in the outer partition plate 11 subject to the selected code and the other buttons 15 in the other holes in the outer partition plate 11, and then install the locking mechanism 3 in the shell 16 again.

When the total number of the buttons is 9 and 5 buttons are selected for real-code buttons, more than 150 thousands of code combinations are available. When total 12 buttons are provided and 6 buttons are selected for real-code buttons, more than 650 thousands of code combinations are provided.

A prototype of combination lock has been constructed with the features of the annexed drawings of FIGS. 1~5. The combination lock functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A combination lock comprising a core unit, a reset mechanism, and a locking mechanism, wherein said reset mechanism comprises a reset guide rod, a sliding plate, a return spring, a holder frame, a stop rod, and a reset member, said reset guide rod being fixedly connected between two end flanges of a push board of said core unit, said sliding plate, said return spring and said holder frame being respectively mounted on said reset guide rod, said sliding plate having a rectangular opening and a rack at a bottom side thereof, said return spring being sleeved onto said reset guide rod and stopped between one end of said holder frame and a locating ring at one end of said reset guide rod, said stop rod having a bottom stop end curved at an acute angle and engaged with said rack of said sliding plate and a top end connected to a projecting rod at said reset member, a middle part pivotally connected to said holder frame by a pivot and a spring member, said reset member being an angled member having a longitudinal sliding slot longitudinally disposed on the middle and coupled to a shell of said core unit by a rivet.

2. The combination lock as claimed in claim 1, wherein said core unit comprises an inner partition plate and an outer partition plate, and a movable securing member mounted in between said inner partition plate and said outer partition plate and adapted to stop operation buttons of said core unit from escaping out of the combination lock.

3. The combination lock as claimed in claim 1, wherein said core unit further comprises a push board and a plurality of real-code buttons and false-code buttons mounted in said inner partition plate and said outer partition plate, said push board and said inner partition plate being disposed in between said outer partition plate and the shell of said core unit; said a center guide rod and said stop rod of said core unit are respectively connected to said push board, said center guide rod holding said return spring and axially movably inserted through an axle bush in said inner partition plate and an axle bush in said outer partition plate.

4. The combination lock as claimed in claim 3, wherein said real-code buttons each comprise an axially extended chamber, a screw bolt threaded into said chamber, a return spring mounted inside said chamber and having one end thereof stopped against said screw bolt and an opposite end extended out of said chamber and fastened to a corresponding through hole in said inner partition plate in which the respective real-code button is inserted, and a push rod extended from one end thereof opposite to said screw bolt, the push rod of each of said real-code button being extended through said inner partition plate and having a beveled push face disposed outside said inner partition plate.

5. The combination lock as claimed in claim 4, wherein the screw bolts of said real-code buttons are respectively marked with a respective digit or letter.

6. The combination lock as claimed in claim 1, wherein said locking mechanism comprises a pivoted stop rod, a shaft, a push rod, an actuating rod, and a locking rod, said pivoted stop rod having a fixed end pivoted to said locking mechanism and a free end, said shaft having a first annular locating groove and a second annular locating groove respectively extended around the periphery, said push rod and said actuating rod being respectively aimed at a through hole in the shell of said core unit, said push rod being supported on a spring of said locking mechanism and forced by the spring against the free end of said pivoted stop rod, said pivoted stop rod having a sloping projection engaged into the first annular locating groove of said shaft, said locking rod having a first end adapted to engage the second annular locating groove of said shaft and a second end pivoted to one end said actuating rod.

7. The combination lock as claimed in claim 6, wherein said actuating rod has a first end pivoted to the second end of said locking rod, a middle part pivoted to a support rod, and a second end terminating in a press portion, which extends to the through hole of the shell of said core unit.

* * * * *